United States Patent [19]

Riou et al.

[11] 3,962,010

[45] June 8, 1976

[54] METHOD OF MANUFACTURING A BODY FOR A VALISE, SUITCASE, ATTACHE CASE OR SIMILAR ARTICLE

[75] Inventors: Joannes Riou; Pierre Silvestri, both of Saint-Etienne, France

[73] Assignee: Rusi Societe, Saint-Etienne, France

[22] Filed: Jan. 8, 1975

[21] Appl. No.: 539,433

Related U.S. Application Data

[63] Continuation-in-part of Ser. No. 271,536, July 13, 1972, abandoned.

[52] U.S. Cl. ..... 156/93; 156/73.4; 156/197; 156/217; 156/304; 190/49; 190/58 R; 190/59; 428/116; 428/119; 428/188

[51] Int. Cl.[2] ..... B32B 7/08

[58] Field of Search ..... 156/93, 73.4, 217, 218, 156/304, 197; 190/48, 49, 58 R, 59; 428/188, 116, 120

[56] References Cited

UNITED STATES PATENTS

| | | | |
|---|---|---|---|
| 383,175 | 5/1888 | Gardner | 156/217 |
| 2,952,039 | 9/1960 | Jaffe | 156/218 |
| 3,298,480 | 1/1967 | Kish | 190/54 |
| 3,519,507 | 7/1970 | Pierson | 156/73.4 |
| 3,567,537 | 3/1971 | Marteny et al. | 156/93 |
| 3,579,804 | 5/1971 | Slan | 190/49 |
| 3,663,332 | 5/1972 | Gard | 156/217 |
| 3,730,309 | 5/1973 | Hamann et al. | 190/49 |

*Primary Examiner*—Edward G. Whitby
*Attorney, Agent, or Firm*—Haseltine, Lake & Waters

[57] ABSTRACT

A method of manufacturing a body or frame for a valise, suitcase, attache case, or other similar article made of shaped plastic material, which is adapted for travel and personal use. A base or body frame is manufactured from a preferably profiled plastic member having the shape of a strip or band which is cut to a length corresponding to the periphery of the article, and which is then shaped and assembled; or by providing a profiled member whose cross-section corresponds to the shape of the valise, suitcase, attache case or similar article, which is cut to a predetermined size; and a lid or valise cover frame which cooperates with the body in a novel shaping arrangement of the lid and the body, or through the intermediary of an appropriate recessed portion proximate their adjoining regions; and with a suitable bottom and sheathing adapted to be optionally attached in a known manner in order to form a finished valise structure.

18 Claims, 14 Drawing Figures

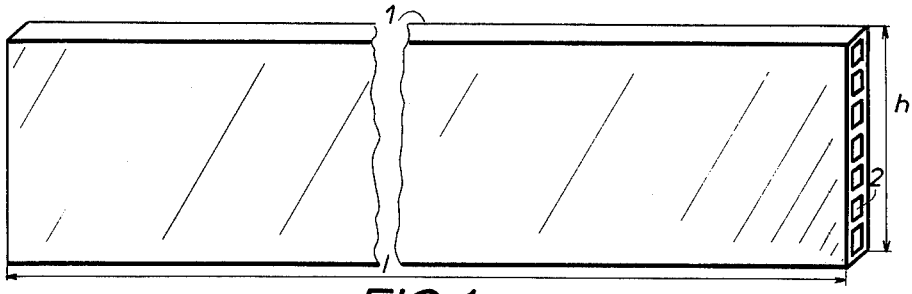
FIG.1
FIG.2
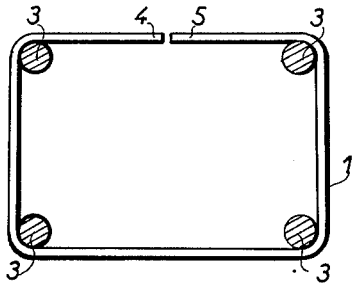
FIG.3
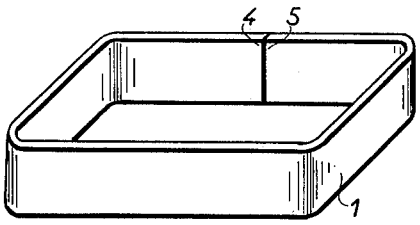
FIG.4
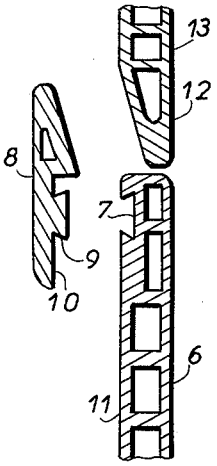
FIG.5
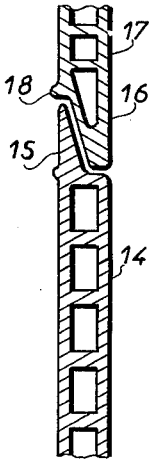
FIG.6
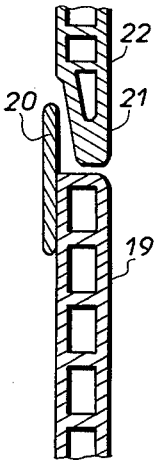
FIG.7
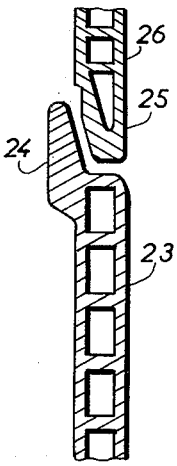

METHOD OF MANUFACTURING A BODY FOR A VALISE, SUITCASE, ATTACHE CASE OR SIMILAR ARTICLE

FIELD OF THE INVENTION

This application is a continuation-in-part application of Ser. No. 271,536; filed July 13, 1972, now abandoned.

The invention relates to a method of manufacturing a body or frame for a valise, suitcase, attache case, or other similar article made of shaped plastic material, which is adapted for travel and personal use.

The invention further relates to methods of shaping of plastic materials, as well as to the assembly of these so as to constitute a luggage case, or similar container.

DISCUSSION OF THE PRIOR ART

The manufacture of suitcases of the type mentioned generally requires the use of a stiffening frame or basic body structure which is made of wood, plywood, cardboard, aluminum, fiber or injection molded plastic material. An alternative possibility is to manufacture the valises or suitcases directly and completely, e.g. without the use of a stiffening frame, out of sheets of aluminum, cardboard, fiber or injection molded plastic material.

It is evident that such manufacturing methods require a considerable quantity and variety of tools for stamping, molding or similar sequences, and moreover, the finished strength of valises which are made of cardboard, plywood or fiberboard is quite limited. Furthermore, coating or sheathing and subsequent finishing operations are frequently required in order to improve the appearance of the valise or similar article.

All of these factors result in relatively high expenditures in the manufacture of an article which may have only limited advantageous structural and aesthetic qualities.

BRIEF SUMMARY OF THE INVENTION

Accordingly, it is an object of the present invention to provide a method of forming a body or frame structure for a valise, or the like, which will significantly improve the appearance and the quality of the article, while simultaneously reducing the manufacturing costs through the utilization of a simple and rapid method for a forming operation, which eliminates the need for expensive tools.

Another object of the present invention is to provide a novel and improved method of aligning the main body frame portion of the valise with a suitable cover or lid frame.

Still another object of the present invention is to provide a novel construction for the adjoining the valise body and cover frame portions in predetermined aligned cooperative relationship upon the closing of the valise.

In order to obtain the above and other objects, a base or body frame is manufactured from a preferably profiled plastic member having the shape of a strip or band which is cut to a length corresponding to the periphery of the article, and which is then shaped and assembled; or by providing a profiled member whose cross-section corresponds to the shape of the valise, suitcase, attache case or similar article, which is cut to a predetermined size; and a lid or valise cover frame which cooperates with the body in a novel shaping arrangement of the lid and the body, or through the intermediary of an appropriate recessed portion proximate their adjoining regions; and with a suitable bottom and sheathing adapted to be optionally attached in a known manner in order to form a finished valise structure.

BRIEF DESCRIPTION OF THE DRAWING

Reference may now be had to the following detailed description of preferred embodiments of the invention, taken in conjunction with the accompanying drawing; in which:

FIG. 1 is a perspective view of a profiled strip according to the invention for forming the body portion of a valise or the like;

FIG. 2 is a diagrammatic view illustrative of the operation of bending the strip into the body portion;

FIG. 3 is a perspective view of a body of a valise or similar article after the bending and joining operations of the profiled strip of FIG. 1;

FIGS. 4 to 7 show fragmentary sections of the upper edge portion of various embodiments of valise body structure showing configurations adapted for cooperation with the cover or lid;

DETAILED DESCRIPTION

Figure 8:
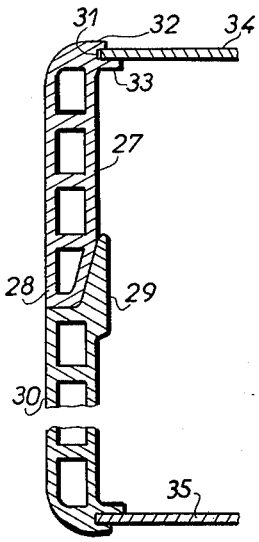
FIGS. 8 to 11 show fragmentary sections of various embodiments of profiled valise body and lid portion structure, with the top and bottom walls shown attached thereto by employing different methods.

Referring now to the drawings, and particularly FIG. 1, a panel or profiled member 1 which is preferably formed of a solid or honeycombed rigid plastic material, has a length L which essentially corresponds to the circumference of the valise, luggage case or similar article into which it is to be formed. The panel or profiled member 1 may be either of solid material or have hollows provided therein in the form of honeycombs 2. The height H of the profiled member is also determined in accordance with the particular height of the body portion of the valise.

Referring now to FIG. 2 of the drawings, the plastic body member 1 is bent or deformed around four spaced poles or cylinders 3, the latter of which are located so as to define the corners of the valise or similar article whereby, upon the profiled member 1 being bent thereabout, the latter assumes the shape of a frame for the valise. The bending operation is effected in the presence of heat, with subsequent cooling after completion of the shaping operation. By means of this method, a bottom body frame portion, as well as a lid or cover frame portion may be constructed in a substantially identical procedure.

At the conclusion of the bending operation, the two open facing or contiguous ends 4 and 5 of the profiled member 1 are then permanently joined together. This may be effected by means of suitable welding or mechanical clamping. Various known methods may be employed for the purpose of welding the ends 4 and 5, in effect, heat contact welding, high-frequency or ultrasonic welding. If high frequency or ultrasonic welding are employed, then an additional insert may be required as a coupling member between the frame ends 4 and 5 so as to form the general shape of a cone having teeth on each side which are inserted and welded in the tunnels or honeycombs of the panel ends (not shown). A finished frame formed by the profiled member 1 and having permanently joined ends 4 and 5 is illustrated in FIG. 3 of the drawings.

FIGS. 4 through 13 illustrate various methods and resultant structures of shaped profiled frames, and methods of forming the interconnections between the cover frame and bottom body frame portions of the valises or the like. Furthermore, the figures also show, wherever desired, the securing of the side wall coverings, also referred to in the trade as jackets, or the walls of the valise or suitcase mounted onto the profiled frame portions.

Having particular reference to FIG. 4 of the drawings, the latter shows, in cross-section, the upper end portion of a body frame 6, which may be of a honeycomb configuration for lightweight structure while concurrently providing rigidity and stiffness, having a cutout or mortise 7 formed therein which extends along the inner peripheral wall of the finished frame. An elongate shoulder member 8 is provided, with continuous tenon 9 adapted to be engaged in the mortise 7 so that the surface 10 will contact the inner wall surface 11 of the frame 6. The upper end of the shoulder member 8 will then project upwardly beyond the top of the frame portion 6 so as to provide a guide for the tapered lower end 12 of an upper lid or cover frame portion 13, which may be shaped similar to that of frame portion 6. This structure will prevent any axial displacement of the frame portion 13 relative to portion 6 upon closing of the valise or suitcase and provide a stable lateral support arrangement therefor.

With respect to FIG. 5, the frame 14 for the body portion of the valise has an upwardly tapered projection 15 formed integrally therewith and extending along the inner surface of the wall, and which is adapted to cooperate with a similarly tapered projection 16 of a valise lid or cover frame portion 17 in order to provide lateral support upon closing of the valise. The shoulder 18 will prevent downwardly overlapping of the cover frame portion 17 with respect to the body frame portion 14.

With respect to FIG. 6, this shows a body frame portion 19 wherein there is fastened to the inner wall, and projecting thereabove, a shoulder 20 constituted of a substantially flat planar strip, which may be either sewn or welded to the body profiled frame 19. This will provide lateral support for the lower tapered end 21 of the cover frame portion 22. If desired, the strip 20 may also be profiled, in effect, be provided with projections such as longitudinal ribs extending along the surface thereof. In this particular construction, the spacing between the cover and bottom frame portions 22, 19 provides clearance for the passing therebetween of twice the thickness of any covering material (not shown) for the valise extending between the cover and bottom frame. Furthermore, the cover frame 22, rather than having the tapered end portion 21, may have a rectangular end portion in cross-section which will meet the bottom or body frame 19 in a fully abutting surface relationship.

In FIG. 7, the bottom or body profiled frame member 23 includes, along the inner upper edge thereof, an upwardly extending projection in the form of a substantially conical cross-section 24 which is adapted to cooperate with a tapered section 25 along the lower edge of the lid or cover frame portion 26, and which provides space therebetween for the passage therethrough of the valise covering material, in effect, twice the thickness of the material, one for the upper and one for the lower portion. In this instance, the projection 24 is integrally formed with the body frame member 23.

The particular profiled frames, constituted by the body and lid frame portions shown in FIGS. 4 through 7, are all adapted to be covered by means of materials comprising jackets, such as artificial leather, naugahyde, canvas or the like which are common to the traditional manufacture of suitcases. Generally, such coverings or jackets encompass the entire exterior face of the frames and, inclusively, may form the side walls of the suitcase.

FIGS. 8 through 11 show various cross-sections of embodiments of plastic material profiled frame members which are not intended to be covered by any material or jackets, since their outside faces are either suitably covered, or provided with indicia or embossing, or laminated thin plastic strips which are also embossed but of a different color than the extruded profile, (not shown) in order to themselves form the finished valise or suitcase exterior. Illustrated in these particular figures of the drawings are various methods of securing the side walls, or bottom and top walls of the valise or suitcase, to the profiled frame members constituted by frames 1.

Thus, as shown in FIG. 8, the lid or cover frame portion 27 has the lower end 28 shaped to cooperatively engage the projection 29 on the lower or body profiled frame portion 30 of the valise so as to provide a peripheral stiffening member preventing lateral displacement upon closure of the valise. The respective opposite ends of lid frame portion 27 and bottom body frame portion 30 are provided with continuous peripheral grooves 31 which are formed by two projections, an outer projection 32 and an inner projection 33, the latter of which is somewhat laterally extended in order to provide a land or supporting surface for the valise top and bottom wall 34 and, respectively, 35. These walls 34 and 35 are adapted to have the ends thereof embedded in the grooves 31, and may then be either welded or stitched onto the respective profiled frame member. In the instance of FIG. 8, the walls 34 and 35 each consist of flat sheets of equal size, which may be formed, if desired, of the same material as the frame portions 27 and 30.

Figure 9A:
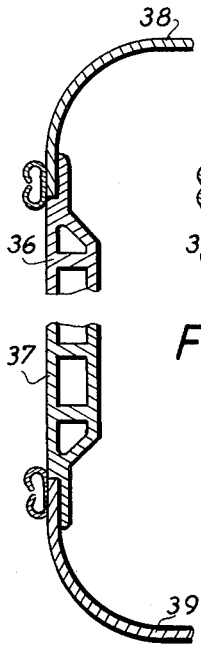

FIG. 9*a* shows profiled lids and body frame members 36 and 37, to which the side walls 38 and 39 may be fastened by means of a stitching, sewing, or welding operation. In this embodiment, the side walls 38 and 39 are not formed of flat sheets but rather are constituted of curvilinearly shaped and molded shells of plastic material or suitable cardboard in order to provide a valise having rounded contours.

Figure 9B:
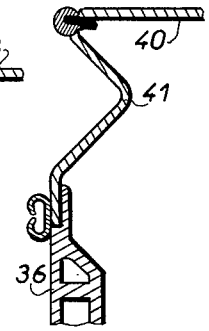

The embodiment of FIG. 9*b* is substantially analogous to that of FIG. 9*a* with the exception that, in this instance, the end walls 40 are formed of flat members and pleated portions 41 so as to constitute, as commonly referred to in the trade, as expandable soft-sided luggage which may be flattened down or expanded in height, depending upon need.

Figure 10:
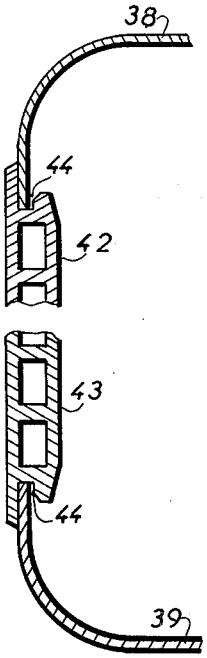

FIG. 10 shows a further embodiment in which the upper and lower frame portions 42 and 43 have the walls 38 and 39, respectively, fastened thereto by means of grooved connections 44 extending along the inside wall of the profiled frame members.

Figure 11:
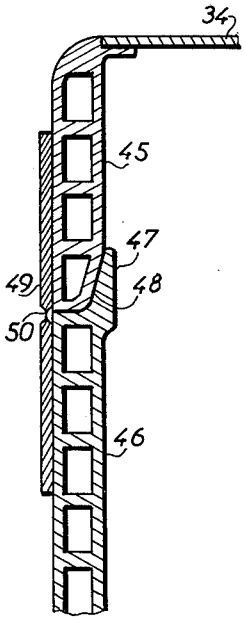

Additionally, in FIG. 11, the lid and bottom frame portions 45 and 46, which are held in alignment by means of the projection 47 located on the bottom or body profiled frame member 46, in cooperation with the tapered end portion 48 on the lid 45 include an attached panel hinge 49 which is constituted of a plastic material having flexibility provided by a grooved portion 50 which reduces the thickness of the plastic material 49 to a fraction of a millimeter, so as to define thereby a narrow horizontally extending centerline or hinge pivot. This hinge 49 may be attached to the frame portions 45 and 46 by means of suitable riveting or welding.

Figure 12:
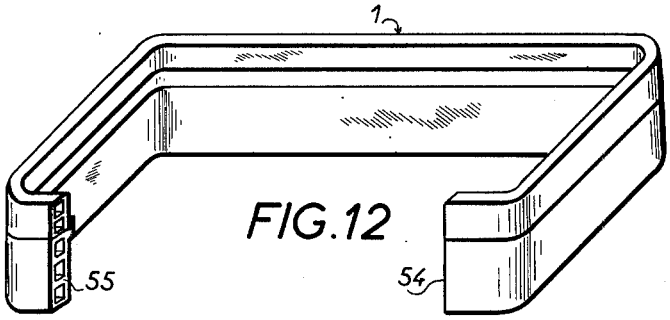
FIG. 12 is a perspective view of a valise body and lid portion frame adapted to be joined by a modified method.
Figure 13:
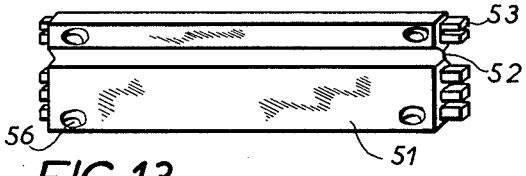
FIG. 13 is an enlarged detail of a linking panel employed with the structure of FIG. 12.

Shown in FIG. 12 is a further modification of stiffening frame for valises and the like. In this instance, the open ends of the lid and lower body frame portions are adapted to be closed by means of a linking panel 51 as shown in FIG. 13 of the drawings. This linking panel is made of an injection molded plastic material and forms a lid and bottom part which are retained together along a narrow continuous horizontal line of reduced thickness 52, which will provide hinging action analogous to that as described with respect to member 49 in FIG. 11. The two ends thereof are provided with tenons 53 which are adapted to be inserted and then welded into the honeycomb apertures in the open ends of the frame shown in FIG. 12. These open ends are identified by, respectively, 54 and 55. This linking panel may be utilized in connection with all of the frame portions referred to and described in FIGS. 8 through 11 of the drawings. Protective studs 56, often referred to in the trade as suitcase bottoms, may concurrently be injection molded into the panel.

While there has been shown what is considered to be the preferred embodiment of the invention, it will be obvious that modifications may be made which come within the scope of the disclosure of the specification.

What is claimed is:

1. A method of manufacturing a stiffening frame forming the body of a valise, suitcase, luggage and similar article, constituted of a bottom body frame and a complementary adjoining lid frame, each said frame being of a honeycombed material and formed by the steps of: cutting a section from a profiled strip of plastic material of honeycombed cross-section having a width corresponding to the height of a respective frame being formed by said strip and of a length conforming to the periphery of the article; bending said strip about an axis perpendicular to said strip length while concurrently applying heat thereto so as to form said frame configuration in conformance with the generally finished peripheral contour of said body; and mutually joining the adjacent ends of said formed strip ends to provide a substantially finished article body.

2. A method as claimed in claim 1, at least one said frames having a shaped edge adjacent the adjoining frame adapted to provide cooperative interengagement between said frames for preventing relative lateral movement therebetween upon said frames being positioned in valise-closed superposition.

3. A method as claimed in claim 2, said bottom body frame having a profiled projecting shoulder at said shaped edge adapted to be engaged by a complementary shaped edge on said lid frame.

4. A method as claimed in claim 3, said shoulder being integrally formed with said bottom body frame.

5. A method as claimed in claim 3, said shoulder including a flat plate; comprising sewing said flat plate to said bottom body frame.

6. A method as claimed in claim 2, said bottom body frame having a mortise formed along the edge thereof proximate said lid frame, an abutment having a tenon engaging said mortise extending along said frame and including a projecting portion adapted to be engaged by a complementary shaped edge on said lid frame.

7. A method as claimed in claim 1, comprising forming elongate grooves along respectively said bottom body frame and said lid frame for insertion and fastening valise bottom and top wall portions therein.

8. A method as claimed in claim 1, comprising forming said frames into substantially rectangular configurations.

9. A method as claimed in claim 8, comprising joining the contiguous ends of said frames by means of welding.

10. A method as claimed in claim 8, comprising clamping the contiguous ends of said frames.

11. A method as claimed in claim 1, comprising forming a hinge connection between said lid frame and said bottom body frame, said hinge connection being a plastic panel fastened to said plates, and forming a reduced thickness groove portion therein for bending movement thereof.

12. A method as claimed in claim 1, comprising positioning a linking panel between the contiguous ends of said frames.

13. A method as claimed in claim 1, comprising shaping the spaced apart free edges of said respective frames for welding attachment of valise top and bottom wall portions.

14. A method as claimed in claim 1, comprising forming means on said respective frames for sewing attachment of valise top and bottom wall portions.

15. A method as claimed in claim 1, comprising forming decorative embossing on surfaces of said frames.

16. A method as claimed in claim 1, comprising laminating embossed plastic strips onto the surface of said frames.

17. A method as claimed in claim 1, comprising covering said frames with a jacket material.

18. A method as claimed in claim 1, said frames being formed of solid material in cross-section.

* * * * *